US005491959A

United States Patent [19]

Jenne

[11] Patent Number: 5,491,959

[45] Date of Patent: Feb. 20, 1996

[54] DROP PACKERS

[75] Inventor: Richard Jenne, Cleveland, Ohio

[73] Assignee: Hartness International, Inc., Greenville, S.C.

[21] Appl. No.: 313,764

[22] Filed: Sep. 28, 1994

Related U.S. Application Data

[63] Continuation of Ser. No. 827,018, Jan. 28, 1992, abandoned, which is a continuation-in-part of Ser. No. 554,717, Jul. 18, 1990, abandoned.

[51] Int. Cl.[6] ..... B65B 35/30

[52] U.S. Cl. ..... 53/534; 53/246; 53/251

[58] Field of Search ..... 53/48.1, 244, 246, 53/247, 251, 534, 539, 543

[56] References Cited

U.S. PATENT DOCUMENTS

| | | | |
|---|---|---|---|
| 2,319,167 | 5/1943 | Stewart . | |
| 2,921,425 | 1/1960 | Seval . | |
| 2,978,854 | 4/1961 | Fairest . | |
| 3,142,947 | 8/1964 | Walter . | |
| 3,332,200 | 7/1967 | Englander | 53/534 X |
| 3,377,774 | 4/1968 | Nigrelli et al. | 53/534 X |
| 3,491,511 | 1/1970 | Nigrelli et al. . | |
| 3,553,927 | 1/1971 | Anglade, Jr. . | |
| 3,599,397 | 8/1971 | Standley et al. | 53/534 X |
| 3,601,948 | 8/1971 | Ehe . | |
| 3,601,952 | 8/1971 | Cato . | |
| 3,805,476 | 4/1974 | Kawamura et al. . | |
| 3,864,890 | 2/1975 | Ullman . | |
| 4,005,562 | 2/1977 | Vischer . | |
| 4,064,987 | 12/1977 | Rowan | 53/246 X |
| 4,294,057 | 10/1981 | Winiasz et al. | 53/251 X |
| 4,332,123 | 6/1982 | Calvert . | |
| 4,389,832 | 6/1983 | Calvert | 53/48.1 |
| 4,494,644 | 1/1985 | Rizzo, Sr. . | |
| 4,522,011 | 6/1985 | Bauers et al. . | |
| 4,531,345 | 7/1985 | Nigrelli et al. . | |
| 4,896,474 | 1/1990 | Osteen et al. . | |
| 4,901,501 | 2/1990 | Raudat et al. . | |
| 4,932,191 | 6/1990 | Wild . | |
| 4,998,399 | 5/1991 | Lutzke et al. | 53/534 X |
| 5,020,306 | 6/1991 | Raudat . | |
| 5,197,261 | 3/1993 | Hartness et al. . | |

*Primary Examiner*—John Sipos
*Assistant Examiner*—Daniel Moon
*Attorney, Agent, or Firm*—Dority & Manning

[57] ABSTRACT

Bottles or like articles are fed singly in ungrouped bottle-to-bottle contact in a continuous path by gravity feed in sequence onto horizontally moved cases carried by a conveyor disposed below the line of movement of the bottles or like articles, the case conveyor moving the cases at a predetermined speed. The bottles are conveyed to the cases on inclined paths and/or spaced rails, the bottles being slidably movable on portions adjacent the inclined paths and/or spaced rails. In one embodiment the bottles are suspended from rails in bottle-to-bottle contact. Detectors may be provided for detecting the height of the bottles, disposition of the caps thereon, positioning of the bottles in the cases, and eliminating jamming or improper spacing of the cases.

10 Claims, 9 Drawing Sheets

DROP PACKERS

This is a file-wrapper continuation of application Ser. No. 07/827,018 filed on Jan. 28, 1992, abandoned which is a Continuation-In-Part of U.S. Ser. No. 07/554,717, filed Jul. 18, 1990, abandoned.

FIELD OF THE INVENTION

This invention relates to a continuous bottle packer where the bottles are conveyed to packing cases, and deals particularly with packers of the type referred to which can be retrofit to existing drop action packers without changing their function as drop packers. Drop packers of the prior art handle the flow of bottles in slugs including means to alter the number of containers in each slug.

In the past such drop action packers have been subject to interruptions in production caused by problems in the placement of bottles in the packing cases such as jamming and stoppage of the packers which requires machine-side prior presence of operators and down-time for the machine. Said machines are automatically operated and readily malfunction.

BACKGROUND OF THE INVENTION

The presently preferred form of the invention involves apparatus for providing for movement of an undetermined mass of ungrouped bottles in bottle-to-bottle contact and gravity fed down an inclined path or paths and deposited in sequence into cases moving in case-to-case contact horizontally beneath the paths on conveyor means and positioned beneath and adjacent the exit end of the inclined paths, the leading edges of the bottoms of adjacent bottles; becoming further apart in the horizontal case-moving direction upon descent. Said cases can be of any length capable of housing the bottles i.e. 2, 3, 4, 5, 6 bottles, etc. in a lane. Any combination of the same can be randomly fed non-stop through the packing operation. The lane or path may comprise rails carrying in adjacent lanes two or more series of bottles and the apparatus can be retrofit to existing continuous drop packers and conveyor means associated therewith or employed with other conveyor means leading to and away from the packing site. Means are provided to control the speed of the bottles leading to the cases of the packer of this invention. Control means are also provided to automatically detect any failure of delivery of bottles to the inclined path, lane or rails and to stop the machine in such an event until bottles are again delivered in a line to the path or paths whereupon the movement of bottles in the line is once more resumed and control means are also provided to indicate and stop the machine if improper spacing occurs between the cases or the bottle improperly seats in a case or the like.

An object of this invention is to produce bottle packing mechanisms which can be retrofit on straight-through case feed drop packers and to feed thereto bottles in a continuous manner into the cases by placement of the same therein without interruption in the process and without the need of standby operating personnel to re-establish the operating cycle when malfunction occurs.

A further object of the invention is to provide a continuous motion packer which is inexpensive in manufacture, highly efficient in use, and which provides increased productivity and avoids delays in the operation and the use of unnecessary manpower.

Other objects of the invention and the invention itself will become more readily apparent from a preview of the following description in which description reference is made to the accompanying drawings.

DESCRIPTION OF THE PREFERRED EMBODIMENT

Figure 1:
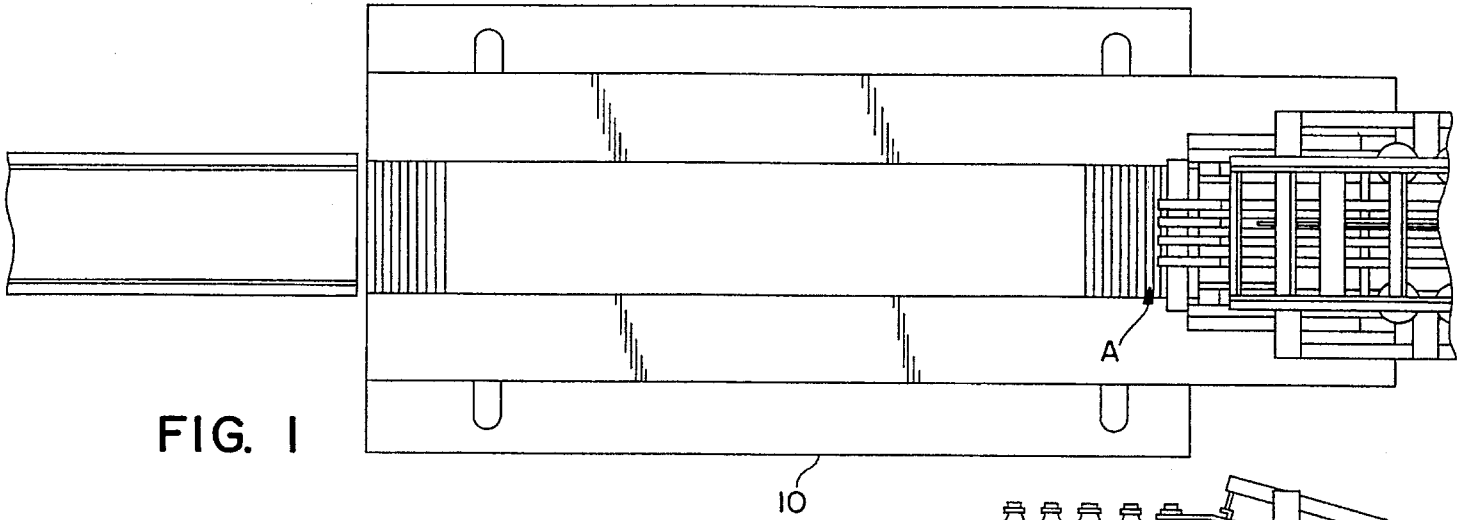
FIG. 1 is a top view of the apparatus of the invention showing bottle and case conveyor means retrofit to infeed bottle and case conveyors of the prior art.
Figure 2:
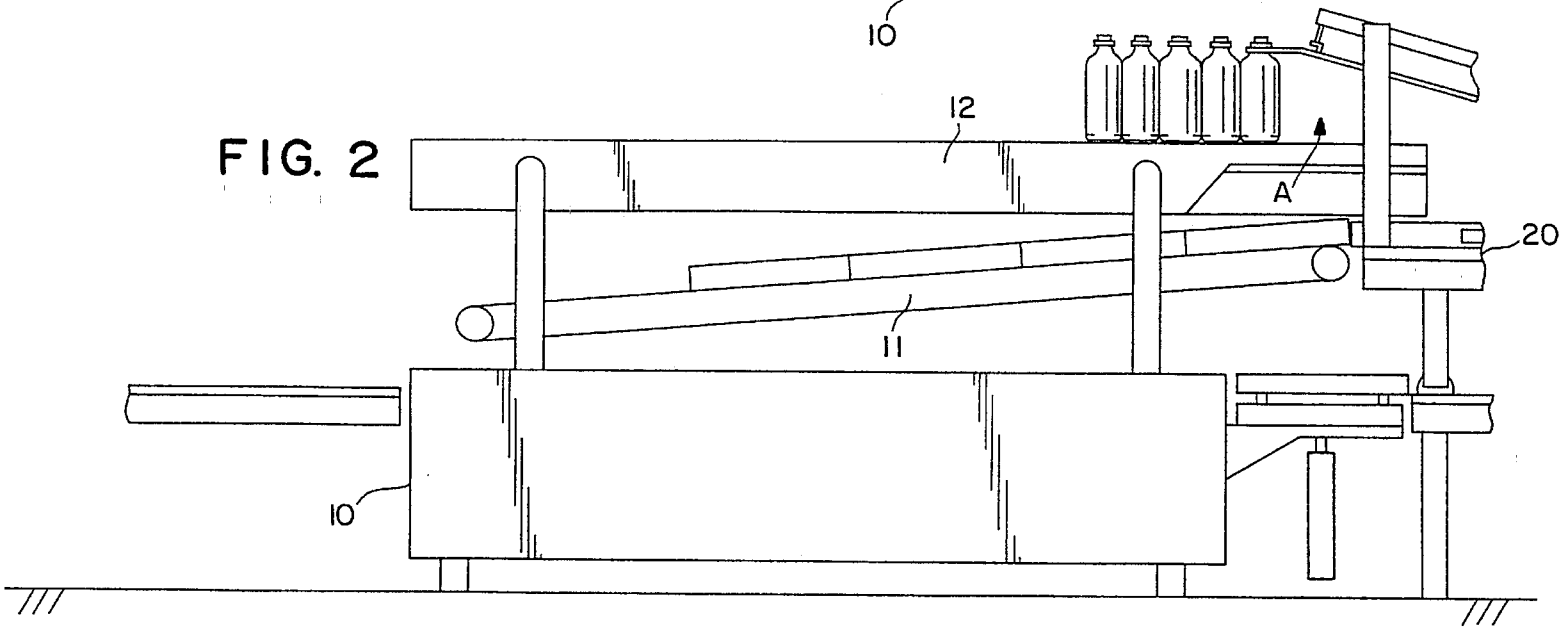
FIG. 2 is a side view of the apparatus of FIG. 1.
Figure 1A:
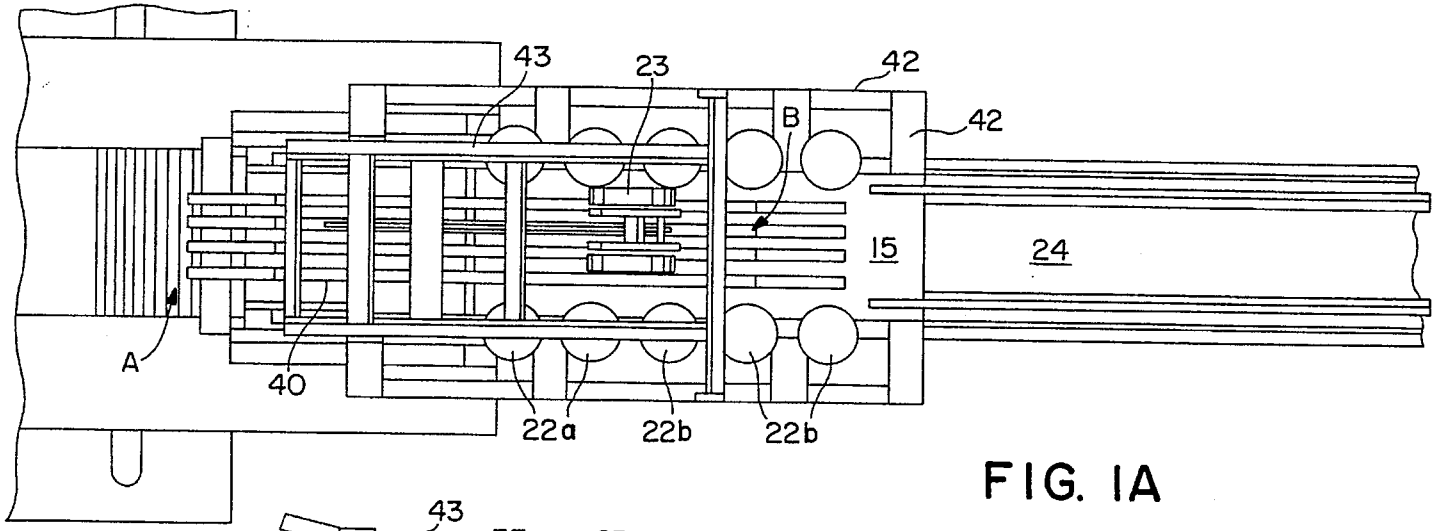
FIGS. 1A and 2A are enlarged top and side views respectively of the bottle carrying and case carrying mechanism of the apparatus of the invention secured to portions of the prior art infeed lines of FIGS. 1 and 2.
Figure 2A:
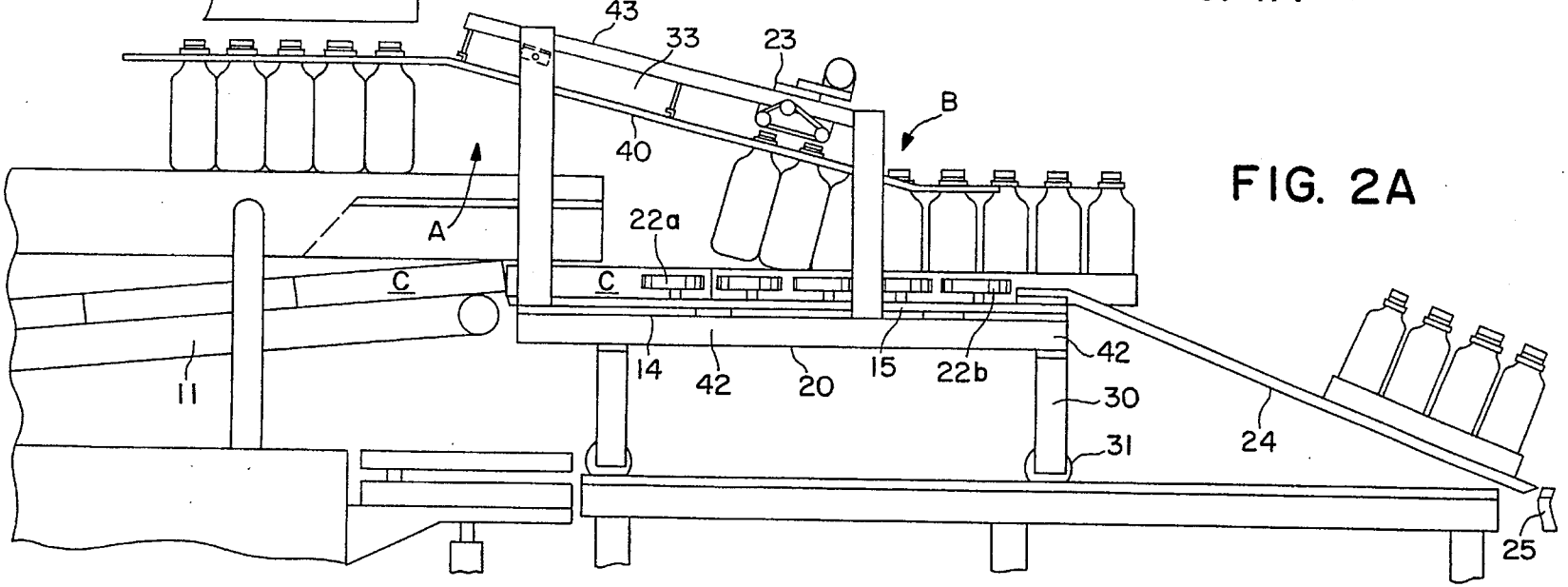
Figure 3:
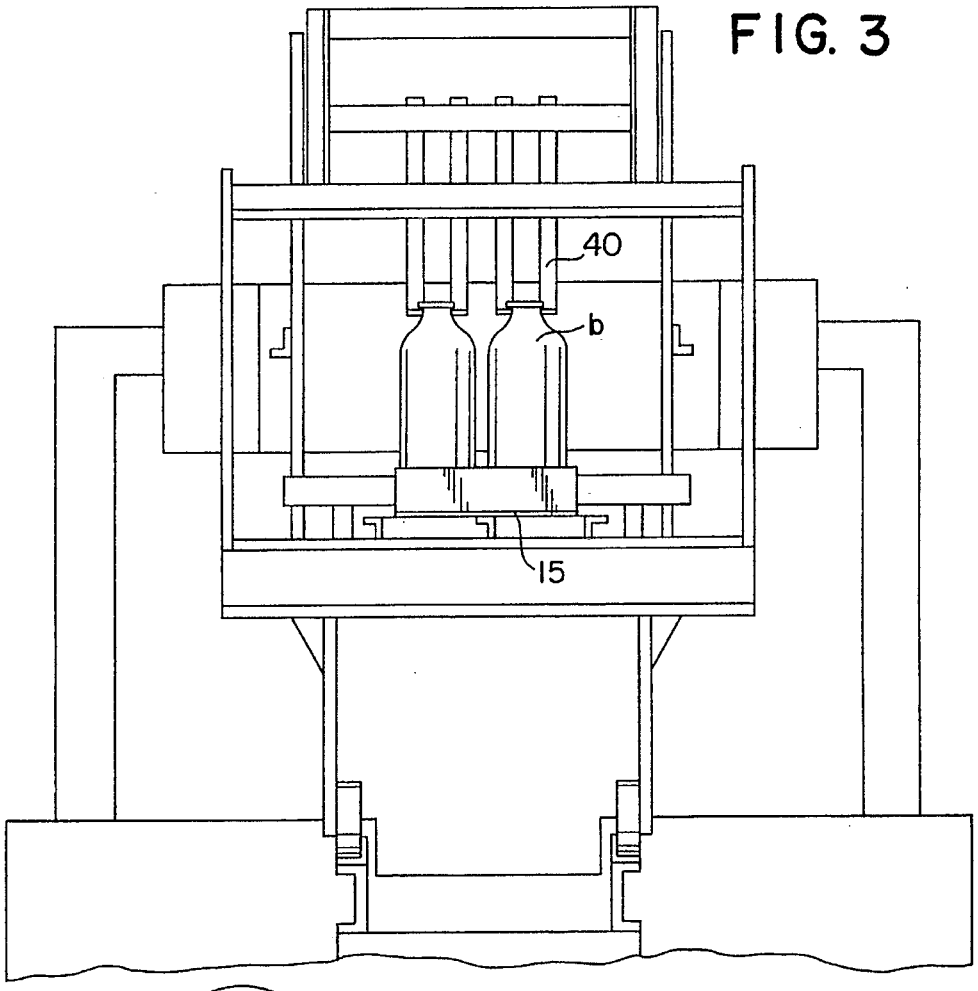
FIG. 3 is a rear enlarged view of the apparatus of FIGS. 1A and 2A.
Figure 5:
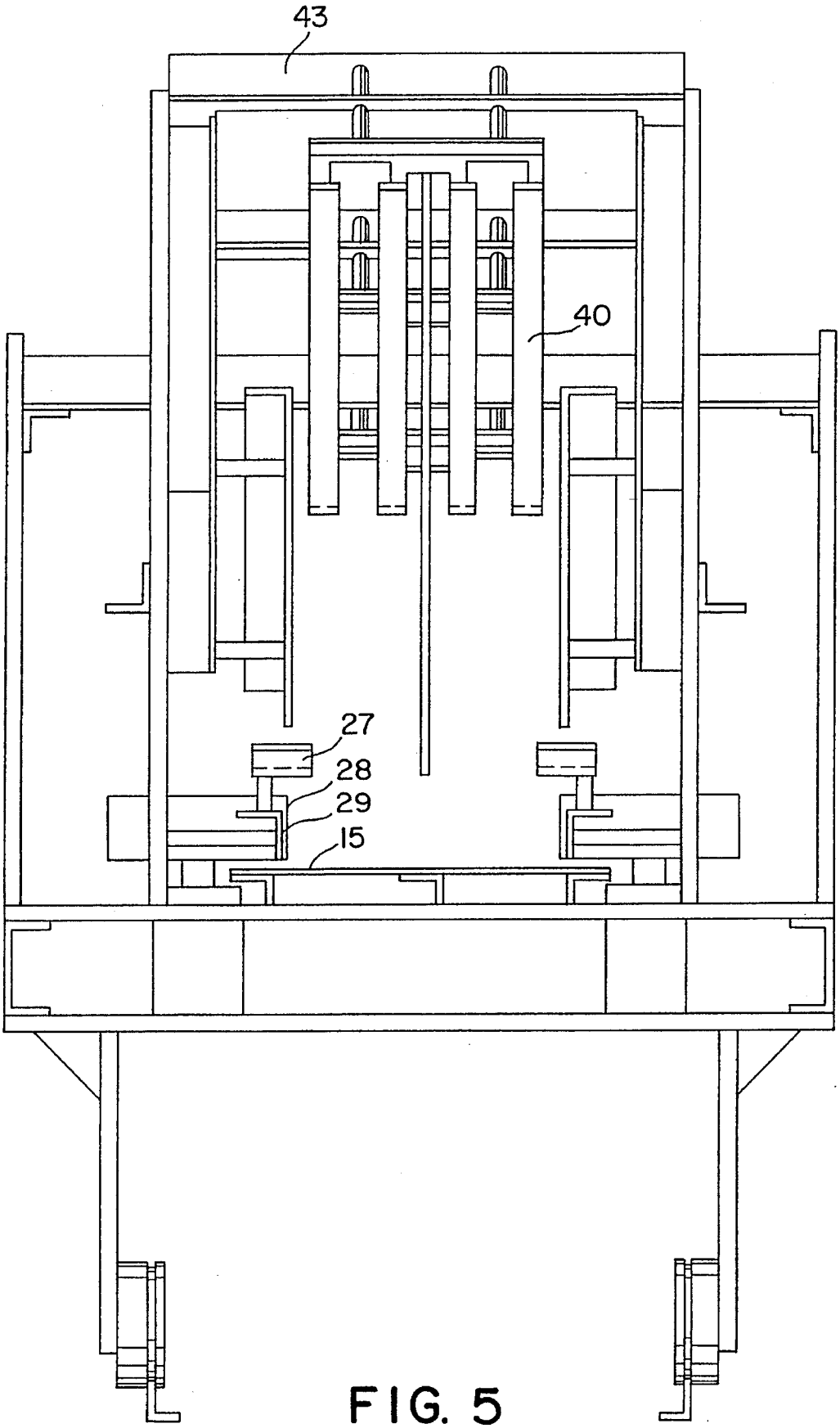
FIG. 5 is a front view of the apparatus of FIG. 4.
Figure 6:
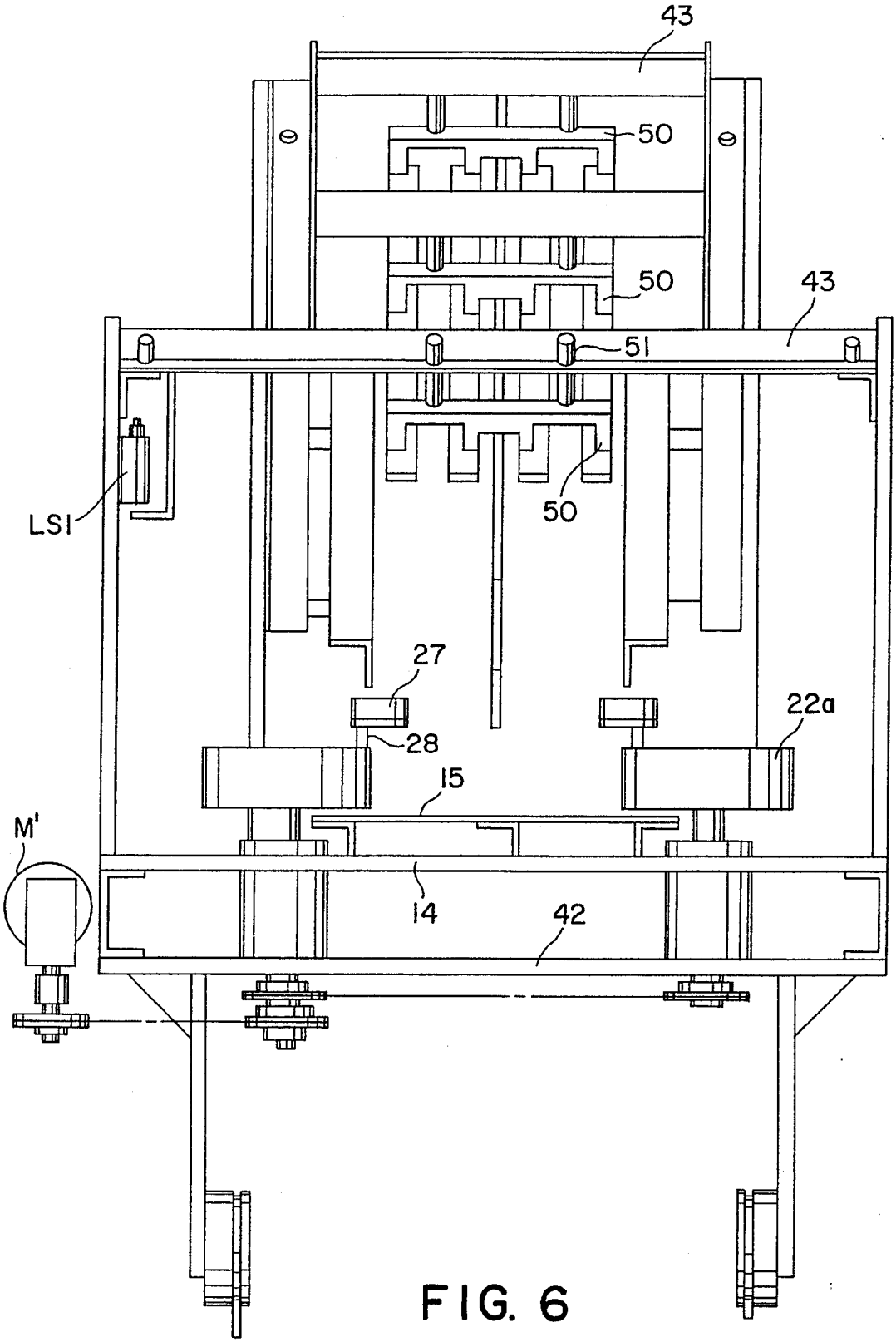
FIG. 6 is a rear view of the apparatus of FIGS. 4 and 5.

Referring now more specifically to the drawings, in all of which like parts are designated by like reference characters, in FIGS. 1 and 2 portions of a prior art drop packer are indicated at 10, and a continuously operated infeed case conveyor is indicated at 11 and a continuously operated infeed bottle conveyor 12 of said drop packer. The apparatus of my invention comprises a frame 20 on which is mounted a continuously operating case conveyor 14 and a continuously operable bottle conveyor 33. Infeed bottle conveyor 12 conveys a supply of bottles "b" to a bottle feed station A at the upper end of bottle conveyor 33, as shown in FIGS. 1, 2, 1A, and 2A. Bottle conveyor 33 extends downwardly along an inclined path to bottle loading station B, as shown in FIGS. 1A and 2A. The case conveyor 14 and conveyor 33 for bottles "b" are, as later described herein, mounted on the frame work 20 which is supported by vertical posts 30 arranged in laterally disposed parallel relationship to the longitudinal direction of motion and provided with rollers 31 or feet adapted to be placed either on a pre-existing longitudinally extending lower conveyor belt or other surface as shown in FIGS. 1A and 2A. The posts or legs support longitudinally extending and vertically spaced rectangular cross frame means 42 and 43 acting as ways for the case conveyor 14 and bottle carrying rails 40 respectively. The case conveyor 14, as shown in FIGS. 3, 5, and 6 is provided with a slide plate 15 at loading station B, where empty cases or trays "c" are received from an infeed case conveyor 11. Case conveyor 14 transports the same to the outfeed case conveyor 24 carried by the frame by means of moving contact with motor operated speed rollers 22*a* and case mover rollers and **22*b* disposed on either side of the conveyor 24, the rollers contacting opposite sides of the cases or trays "c" as shown in FIG. 1**A.

Figure 4:
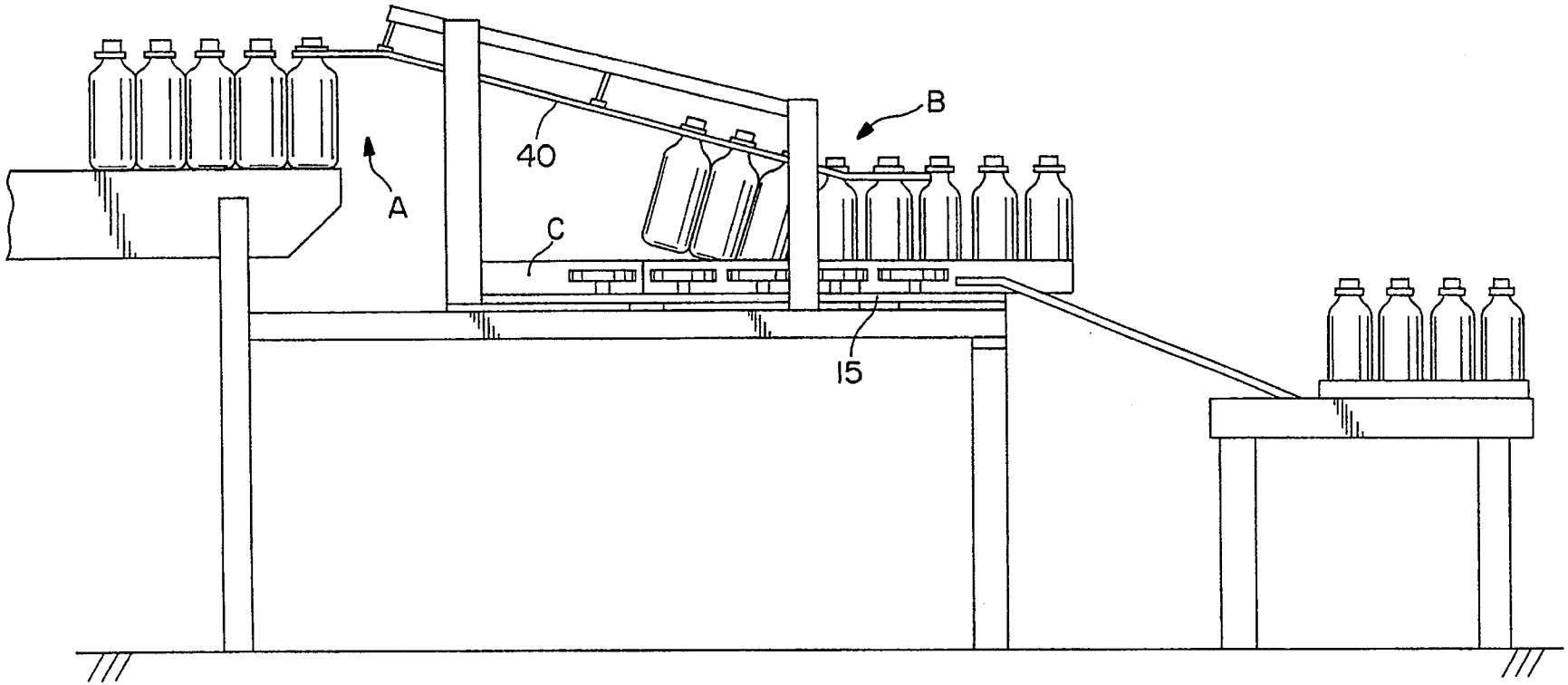
FIG. 4 is a side view of the improved bottle packing apparatus of the invention.

It should be noted that the trays or cases "c" are preferably of a type having no partitions or provided with preformed bottle size partitions of a size sufficient to receive the bottom portions of bottles "b" deposited therein as later described. As shown in FIG. 4, each of the cases "c" are either partitioned or sized to accommodate a predetermined number of bottles.

Figure 9:
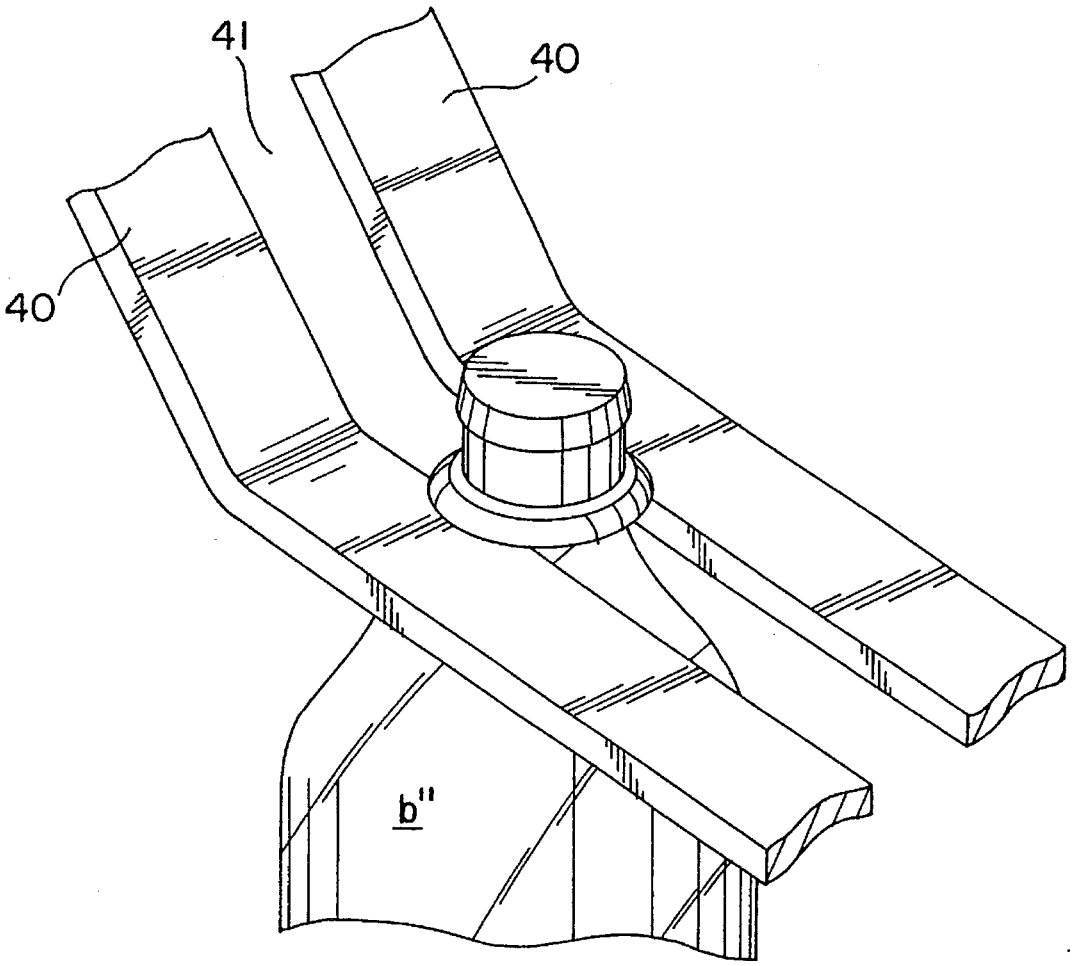
FIG. 9 is an enlarged view of a pair of spaced rails shown in FIG. 1 and showing a bottle held therebetween.
Figure 10:
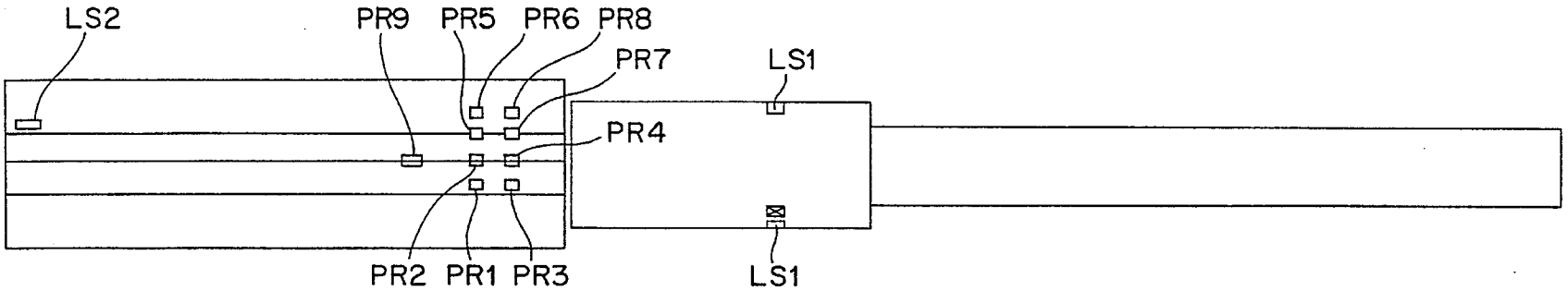
FIG. 10 is a top plan schematic view of electric connections employed in the invention.
Figure 11:
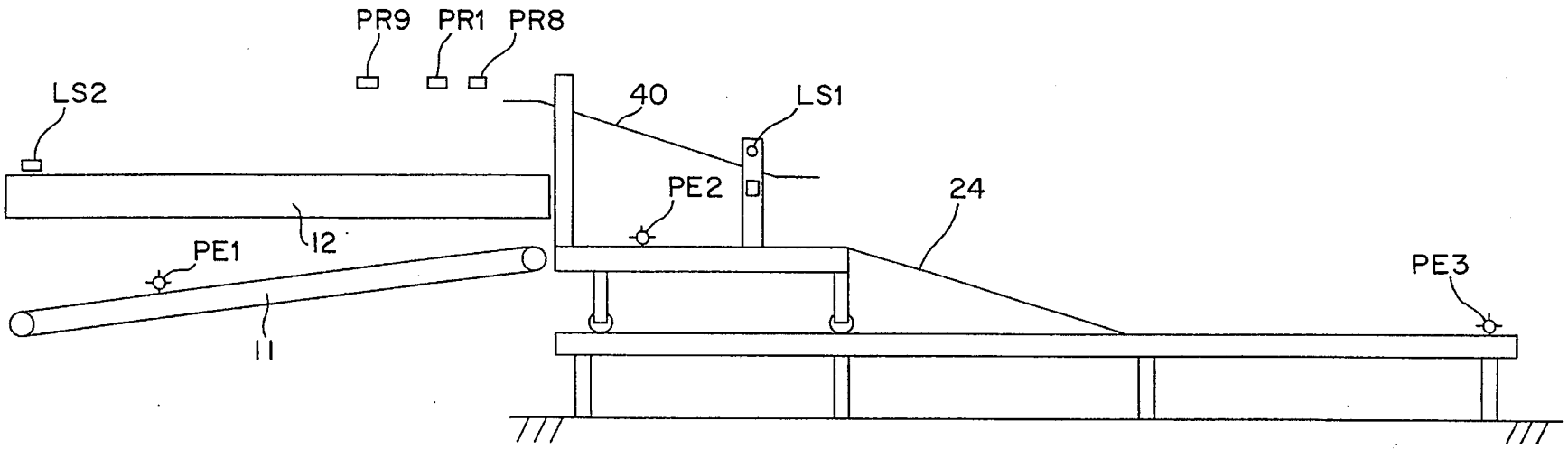
FIG. 11 is a side plan schematic view of the electrical connections of FIG. 10.
Figure 12:
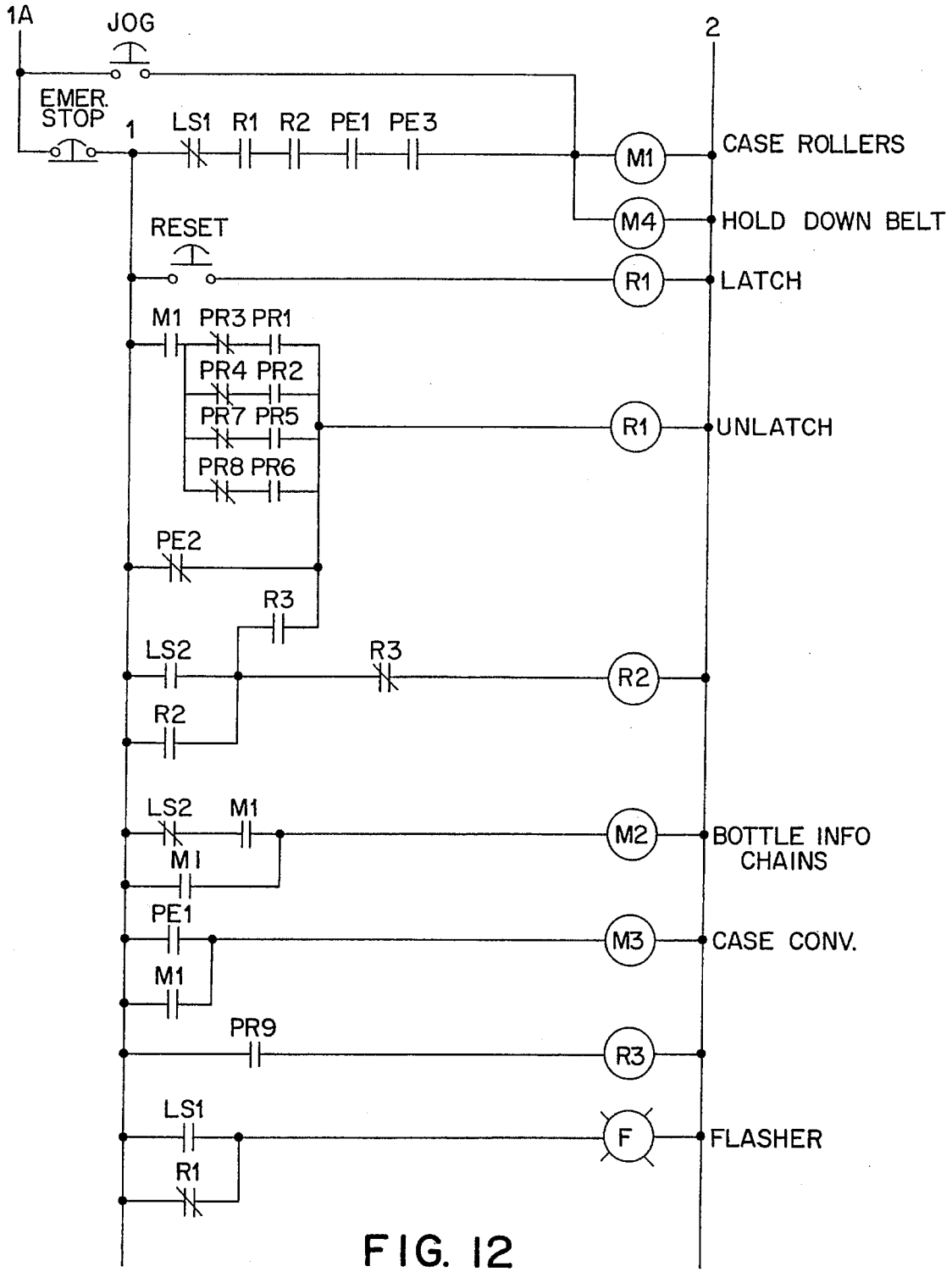
FIG. 12 is a wiring diagram of the apparatus of the invention.

As shown in FIGS. 1A and 2A the cases are moved in case-to-case contact onto the slide plate 15 provided on the case conveyor 14 at loading station B from the conveyor 11 by action of a feed motor M' shown in FIG. 6 driving or braking through a common gear box and chain driven or by other motion means or timing belts. A first set of speed rollers **22*a* is operated at a higher speed than those of a second set of case mover rollers 22*b* by selected action of the gearing and chain drive provided. The rollers determine the speed of the packer and act as case brakers when the machine, for whatever reason stops. The bottles previously seated in the case further act as bottle stops for the oncoming supply of bottles from the rails. The packed cases, once clear of the above described case motion means, move horizontally to receive the bottles moving downwardly on an inclined path as on the rails 40 to loading station B and further move onto the slide conveyor 24 as shown in FIGS. 2A, 4, 9 and 11, from which they are transported along the line by a conveyor 25 aligned therewith or a retrofit conveyor to which the cases are directed from the downwardly inclined conveyor means 24. Automatic controls, as shown in FIGS. 10, 11, and 12 are associated with the continuous motion packer of this invention to control the bottle and case supplies and to stop the case drive motor when a case is blocked or lacks proper timed sequence or spacing. The cases are fed between case top and side guides 27 and 28 mounted on a mounting rod 29 disposed at either side of the slide plate 15, as best shown in FIG. 5**.

Figure 7:
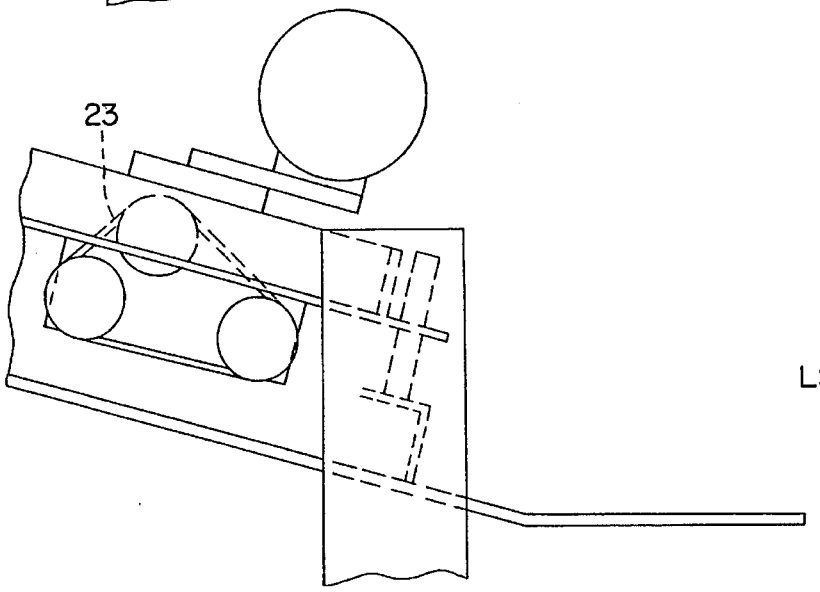
FIG. 7 is a fragmentary view of a bottle hold down device.
Figure 8:
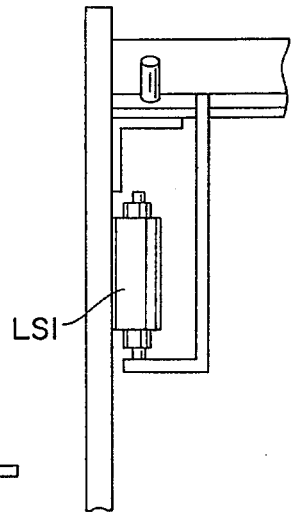
FIG. 8 is a top view of a device shown in FIG. 1.

The bottle carrying conveyor of an embodiment of my invention illustrated herein comprises a plurality of spaced parallel longitudinally extending rails 40 formed into lanes 41, which rails are mounted downstream of the case and bottle conveyors 11 and 12 and accept and provided entry of bottles at loading station A in bottle-to-bottle contact conveyed thereto and transport bottles conveyed thereto by the conveyor 12. The spaced rails 40 in the embodiment of and as shown in FIGS. 1A and FIGS. 3 and 5 are adapted to clasp bottles "b" on either side by adjacent rails and grip the neck of each bottle, as best shown in FIGS. 3 and 9. The lanes of bottles are held in alignment on the rails by spaced means 50 suspended from the framing 43 by threaded bolts 51, as shown in FIGS. 5 and 6. The downwardly inclined bottle conveyor or inclined paths are shown in FIGS. 5, 2A, 4, 9, and 11 and as shown descend to a loading station B above and adjacent the exit end of the horizontally disposed case conveyor 14 wherefor the bottles in bottle-to-bottle contact conveyed by the rails or downwardly inclined lanes or path or paths are gravity fed to the cases passing horizontally below the bottle feed and the bottles are placed automatically in appropriate cases passing therebelow. The bottles as they travel down the incline have longitudinal axes that are at an acute angle to the horizontal moving direction of cases "c", enabling the bottles when a case is filled with the same to maintain in a perpendicular position. The leading edges of the bottoms of adjacent bottles, it will be noted, becomes farther apart in the horizontal case-moving direction as the bottles descend the incline and approach a case to be filled. Powered belt hold-down means 23 are provided on each bottle lane, as shown in the embodiment of FIGS. 2A and 7, and said means 23 are disposed slightly above the cap of each bottle to assist in positioning the bottles into an appropriate space or spaces in the case.

To prime the first case for transport of the cases through the improved apparatus, empty cases "c" are placed on the slide plate 15 between the case movers and the leading edge of a case under the top hold-down belt, the lowering rails and filled with bottles, the first bottle in each lane is placed into the first case, and the top hold-down means 23 are jogged until each lane of bottles is seated in a case. The unit is now primed and ready to run automatically.

In the preferred embodiment, as shown in FIGS. 10 to 12 inclusive, proximity switch means PR9 are provided on each bottle lane. In the event of a bottle not being in proper alignment with other bottles in the lane or if a lane runs out of bottles, the proximity switch means PR9 (common to all lanes) detects the same and the case mover motor M' drive is stopped. At such time, the bottle supply conveyor 33 and the case supply conveyor 14 ceases to run until the limit switch LS1 signals the proximity switch PR9 signalling reinstitution of proper alignment and placement of bottles in the lanes at which time the motor M' will be caused to start. Automatic controls PE1 are provided for the case supply and signal when ample supply is available. When an ample supply case is not available the control causes the motor M1 to stop. Restarting of the case movement thereafter can only begin when the controller PE1 is blocked.

LS2 as shown in FIG. 12, is an automatic control which acts as a metering switch for operating the bottle conveyor feeding the lanes. It is operative to turn on the motor upon receipt of bottles from the bottle conveyor 33. When PE9 and LS2 both signal, a jam or bottle down fault is indicated. Should the packer discharge conveyor back up on PE3, the motor M1 will stop and restart only on clearing of, control PE3. PE2 is located between speed rollers **22*a* and case rollers 22*b*** and detects any gap between the cases and also operates to stop the motor until an operator eliminates the gap and restarts the motor. When the motor runs, the case and bottle conveyor run.

As shown in FIG. 12, safety means PE2 detect unwanted spacing of cases between the rollers. The limit switch LS1 will be operated when a bottle is not seated properly in a case and the bottle is jammed causing the bottle rail to lift up and trips LS1. Other safety devices PR1 and PR3 detect absence of a cap on a bottle in chains leading to lane 1; PR2 and PR4 detect the same in chains leading to lane 2; PR5 and PR7 to lane 3; and PR6 and PR8 to lane 4. Any signal or combination of signals may be employed signalling any of the above problems and will stop the case motor and preferably turn on a flashing light to indicate need for correction. A reset button, after correction of the fault, can be pushed to begin the case and bottle transport operations. Open proximity switch PR9 and limit switch LS1 are both made to indicate a jam or bottle-down fault at PR9. Bottles, in the form shown in FIGS. 1, 2A, 3, 4, 9 and 11 are moved into engagement with the rails 40 mounted above the case conveyor 14, and constitute fixed lanes for successively carrying bottles in fixed contacting relationship to feed said bottles to cases continuously moved on the operating case conveyor 14 which is positioned in spaced relation beneath the inclined bottle carrying rails 40. Each of said cases is adapted to receive a fixed number of bottles therein. The cases "c" as shown receive the bottles "b" at a point adjacent the end of the exit lanes as shown in FIG. 2A. It should be noted that downwardly inclined paths or portions whether provided as shown or by movement of the bottles otherwise on a downwardly inclined sloping surface or path or paths permit the bottles to be deposited by gravity feed down the inclined sloping paths or portions and succeeding bottles in bottle-to-bottle contact with preceding bottles cause such a preceding bottle to drop into an appropriate space in the successive cases passing therebelow.

While I have described the invention in terms of a preferred embodiment thereof, I am aware that numerous and extensive departures may be made therefrom such as other motion or control means or for use with other contents, such as cans without however departing from the spirit of my invention and the scope of the appended claims.

What I claim is:

1. An apparatus for continuously loading a lane of bottles into open packing cases, the apparatus comprising:

an infeed bottle conveyor for advancing a supply of bottles in bottle-to-bottle contact;

an inclined bottle-support slide extending downwardly from said infeed bottle conveyor and terminating with an exit end, said bottle-support slide receiving bottles advanced by said infeed bottle conveyor and slidably supporting the bottles in bottle-to-bottle contact, the bottles received from said infeed bottle conveyor sliding down said bottle-support slide in bottle-to-bottle contact to said exit end of said bottle-support slide; and case conveyor means for conveying a supply of packing cases in case-to-case contact to a loading position below said exit end of said bottle-support slide where the packing cases conveyed by said case conveyor means receive bottles lowered serially in bottle-to-bottle contact to said exit end of said bottle-support slide.

2. The apparatus of claim 1 wherein:

said case conveyor means conveys the packing cases to said loading position in a horizontal conveying direction and conveys the packing cases beyond said loading position;

said bottle-support slide supports the bottles received from said infeed bottle conveyor such that the center lines of the supported bottles form an acute angle with said horizontal conveying direction as the supported bottles are initially received in the packing cases; and as the bottles are fully received in the conveyed packing cases the center lines of the bottles become substantially perpendicular to the said horizontal conveying direction of the packing cases.

3. The apparatus of claim 1, wherein said bottle-support slide includes a pair of laterally spaced downwardly inclined rails, the bottles being supported in suspension between said rails.

4. The apparatus of claim 3, wherein the bottles include neck portions, and the bottles are supported in suspension between said rails by their neck portions.

5. The apparatus of claim 1, wherein said case conveyor means includes:

first rollers adjacent said loading position, said first rollers contacting cases conveyed to said loading position and being driven to urge the cases to move at a first predetermined speed; and second rollers adjacent said loading position and downstream of said first rollers in said horizontal conveying direction, said second rollers contacting cases conveyed to said loading position and being driven to urge the cases to move at a second predetermined speed less than said first predetermined speed, whereby said first and second rollers maintain the cases in said loading position in case-to-case contact.

6. The apparatus of claim 1, further comprising means for assisting the lowering of bottles off said bottle-support slide and into the cases conveyed at said loading position.

7. An apparatus for continuously loading lanes of bottles into open packing cases, the apparatus comprising:

an infeed bottle conveyor for advancing a supply of bottles in bottle-to-bottle contact;

a plurality of inclined bottle-support slides each extending downwardly from said infeed bottle conveyor and terminating with an exit end, each of said bottle-support slides receiving bottles advanced by said infeed bottle conveyor and slidably supporting a lane of bottles in bottle-to-bottle contact, the bottles received from said infeed bottle conveyor sliding down each of said bottle-supports slide in bottle-to-bottle contact to said exit end of said respective bottle-support slide; and case conveyor means for conveying a supply of packing cases in case-to-case contact to a loading position below said exit ends of said bottle-support slides where the packing cases conveyed by said case conveyor means receive lanes of bottles lowered serially in bottle-to-bottle contact to said exit end of said bottle-support slide.

8. An apparatus for depositing into packing cases individual articles from a substantially continuous flow of articles, comprising:

an article feed station;

an article loading station;

an inclined slide having an upper end disposed adjacent said feeding station and a lower end extending to said loading station, said slide being adapted to slidably support a plurality of articles along its length;

means for successively feeding articles in aligned rows to said upper end of said inclined slide so that the articles slide down said slide to said loading station in article-to-article contact;

means for feeding a successive flow of cases to said loading station directly below said lower end of said inclined slide so that articles successively exit said lower end of said slide into the cases in aligned rows of articles;

a case feeding device adjacent said loading station, said case feeding device engaging the cases and forcing the cases toward said loading station in case-to-case contact;

case braking means adjacent said loading station for applying a retarding force to the cases fed by said case feeding device for preventing the cases from being separated from case-to-case contact while articles exit said lower end of said slide into the cases in aligned rows of articles at said loading station.

9. An apparatus for depositing into packing cases lanes of bottles from a substantially continuous flow of bottles, comprising:

a bottle feed station;

a bottle loading station;

an inclined slide having an upper end disposed adjacent said feeding station and a lower end extending to said loading station, said slide being adapted to slidably support a plurality of bottles in bottle-to-bottle contact along its length;

means for feeding a successive flow of cases in a horizontal case conveying direction to said loading station directly below said lower end of said inclined slide;

case flow control means adjacent said loading station for maintaining the cases in case-to-case contact at said loading station;

means for successively feeding bottles in aligned rows to said upper end of said inclined slide so that groups of bottles slide down said slide to said loading station while the bottles in each group are in bottle-to-bottle contact, the bottles exiting said lower end of said slide into individual cases as aligned rows of bottles.

10. The apparatus of claim 9, wherein said case flow control means includes:

first rollers adjacent said loading position, said first rollers contacting cases fed to said loading position and being driven to urge the cases to move at a first predetermined speed; and second rollers adjacent said loading position and downstream of said first rollers in said case conveying direction, said second rollers contacting cases fed to said loading position and being driven to urge the cases to move at a second predetermined speed less than said first predetermined speed, whereby said first and second rollers maintain the cases in said loading position in case-to-case contact.

* * * * *